United States Patent [19]

Stern

[11] 4,102,083

[45] Jul. 25, 1978

[54] PARTICLE SUCTION SYSTEMS

[75] Inventor: Leif E. Stern, Lund, Sweden

[73] Assignee: Bill Peter Philip Nederman, Helsingborg, Sweden

[21] Appl. No.: 732,216

[22] Filed: Oct. 14, 1976

[30] Foreign Application Priority Data

Oct. 16, 1975 [SE] Sweden ..... 7511588

[51] Int. Cl.[2] ..... B24B 23/02

[52] U.S. Cl. ..... 51/170 R; 51/134.5 F; 251/149.5

[58] Field of Search ..... 51/170 R, 170 T, 170 PT, 51/134.5 F, 273; 251/149.6, 149.5, 149.2

[56] References Cited

U.S. PATENT DOCUMENTS

| | | | |
|---|---|---|---|
| 2,928,420 | 3/1960 | Kamenetzky | 251/149.5 |
| 3,964,212 | 6/1976 | Karden | 51/170 T |

*Primary Examiner*—Harold D. Whitehead
*Assistant Examiner*—Roscoe V. Parker
*Attorney, Agent, or Firm*—John J. Dennemeyer

[57] ABSTRACT

A particle suction system wherein a machine tool is connected to a quick coupling device which comprises a pressurized air control valve for regulating the removal of dust particles from the work area. The pressurized air control valve is arranged to follow the quick coupling device when it is disconnected from the machine tool and interrupts the air flow.

6 Claims, 4 Drawing Figures

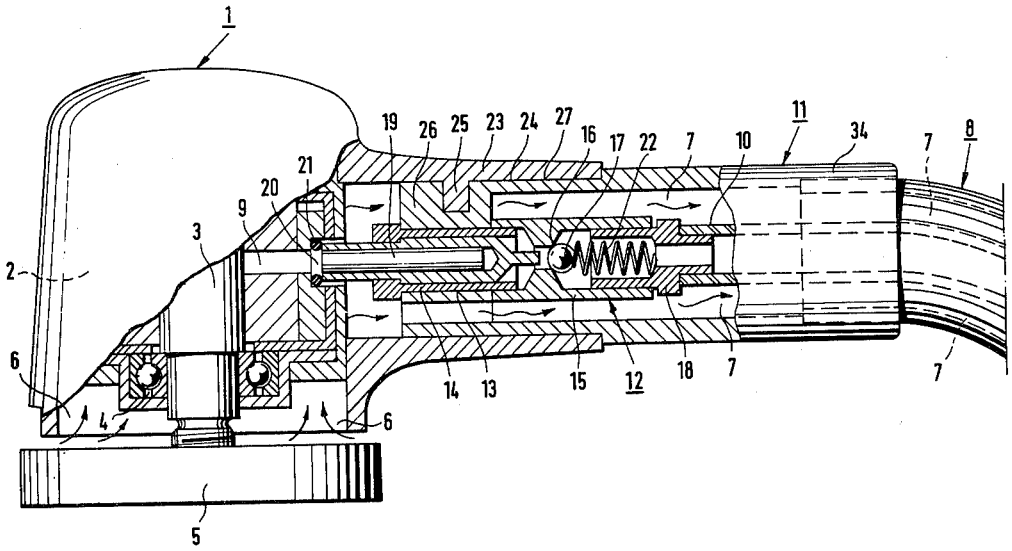

Fig. 2
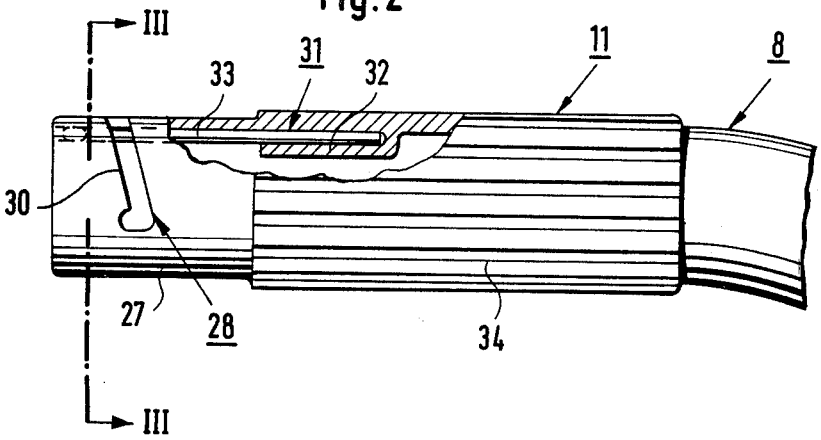
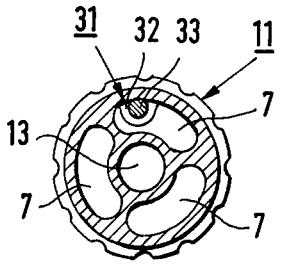
Fig. 3
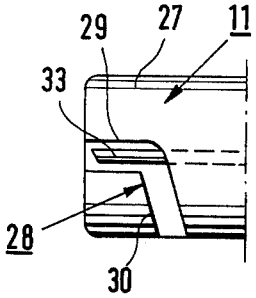
Fig. 4

PARTICLE SUCTION SYSTEMS the present invention relates to improvements in particle suction systems adapted to draw off particles, generally dust particles, which are generated during the operation of pneumatic machine tools, preferably hand tools, for chip-cutting machining purposes, at least one hose being connected to the machine tool through at least one quick coupling device for interconnecting, on the one hand, conduits pertaining to the particles suction system and, on the other hand, conduits pertaining to a pressurized air supply system for supplying air to the driving motor of the machine tool.

In the field of operating pneumatic machine tools for chip-cutting machining work, a plurality of successive machining operations are often required, for which it is usually necessary to employ different machine tools. For instance, in car body repair work involving puttying and repainting, the first thing to be done is to remove damaged lacquer, this being frequently carried out by means of a pneumatic hand tool provided with a rotary grinding wheel. Then generally another operation will follow in which fresh putty is formed into the desired contour with a pneumatic, longitudinally oscillator grinding machine using a coarse abrasive. In this operation grinding stripes are caused which are ground away in the subsequent machining operation by the use of a pneumatic, excentrically rotating grinder with a fine abrasive. In car body repairing work therefore frequently three pneumatic machine tools of different types are required, each tool being connected through an associated hose into a particle suction system. The three machine tools and associated supply hose are often transferred between different work objects, such as cars, for example, within a single workshop. Such transfer is very time consuming because the hoses are an impediment in the transfer operations — in actual practice it frequently occurs that the transfer time exceeds the time taken for carrying out many of the maching operations.

It is an object of the present invention to eliminate these drawbacks and provide simple means in particle suction systems of the type referred to above so that the machine tools can be transferred between different operating objects without having the hoses cause any obstruction thereto. This result is obtained primarily by the fact that at least one valve device forming part of the pressurized air supply system and serving for closing and/or controlling the flow of pressurized air is incorporated into the quick coupling device so as to accompany the latter upon disconnecting the quick coupling device and the machine tool from each other.

In addition to the fact that in many cases the inventive arrangement provides a substantial saving in working hours, the number of hoses forming part of the particle suction system can also be reduced, and the machine tools can be simplified owing to the fact that a valve device forming part of the pressurized air portion of the tools will no longer be required.

The invention will be described in greater detail hereinafter with reference to the accompanying drawings, in which:

FIG. 2 is a side view illustrating the inventive arrangement and a catch device forming part thereof;

FIG. 3 is a cross section taken along the lines III—III in FIG. 2, and

FIG. 4 is a plan view of an end portion of the device illustrated in FIG. 2.

Figure 1:
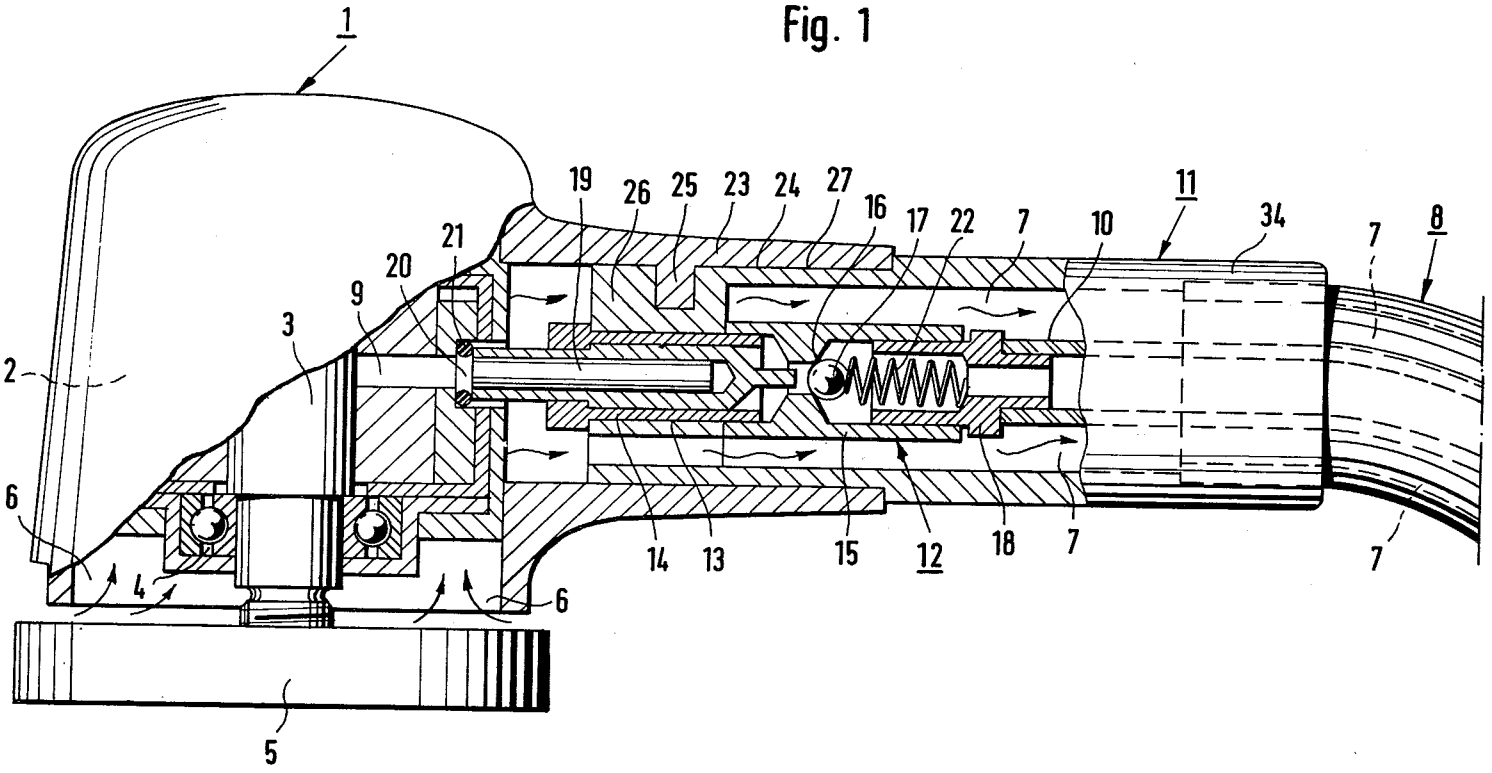
FIG. 1 is a sectional view illustrating a machine tool incorporating the present invention.

The drawings illustrate a pneumatic machine tool for chip-cutting operation. Tthe machine tool, more particularly, is a grinding machine 1 having a pneumatic motor 2 whose power shaft 3 is journalled in the machine by bearing elements 4. The power shaft 3 carries a grinding wheel 5 which is rotated by the driving motor 2 to perform chip-cutting work.

In chip-cutting operations on various objects (not shown) tiny particles usually in the form of dust are generated that could be damaging to health and they are to be sucked away from the work place. Such particle removal is effected by means of a particle suction system which comprises: (a) suction inlet ducts 6 in the grinder 1, (b) at least one suction passageway 7 in a suction hose 8 and communicating with the suction inlet ducts 6, and (c) a suction generating device (not shown) to which the suction hose 8 is connected.

The motor 2 driving the grinder 1 is driven by the action of pressurized air supplied through a pressurized air supply system comprising: (a) at least one pressurized air passageway 9 forming part of the grinder, (b) at least one pressurized air conduit 10 communicating with the pressurized air passageway 9, and (c) a pressurized air generating unit (not shown) to which the pressurized air conduit 10 is connected.

The suction passageway 7 of the particle suction system and the pressurized air conduit 10 of the pressurized air supply system are connected to the respective ducts 6 and 9 within the grinding machine 1 by the suction hose 8 and the pressurized air conduit 10 terminating into a quick coupling device 11 which is connected to the grinding machine 1.

To make possible the use of one single suction hose 8 for several machine tools, for instance grinding machines 1 of the type illustrated, and at the same time to eliminate the need of pressurized air valves in each machine tool, there is provided in the quick coupling device 11, according to the present invention, at least one valve device 12 forming part of the pressurized air supply system 9, 10 and serving for closing and/or controlling the pressurized air flow, the valve device 12 accompanying the quick coupling device 11 upon disconnecting the latter from the grinding machine.

In the embodiment illustrated by way of example of the accompanying drawings the quick coupling device 11 has an internal bore 13. Extending through this bore 13 is a sleeve 14 having one end portion thereof projecting from the bore 13 and forming an extension for rigidly receiving a valve body 15 forming part of the valve device 12. Tthe valve body has a valve seat 16 and a movable valve member 17 cooperating with this seat and having a substantially spherical shape. A connecting sleeve 18 for connecting the pressurized air conduit 10 to the valve device 12 is associated with the valve body 15.

For connecting the valve device 12 to the pressurized air passageway 9 of the grinding machine 1, the valve device comprises a connecting member 19, suitably in the form of a substantially tubulary member which is slidably mounted in the sleeve 14. The grinder 1 is provided with a sealing ring 20 sealingly abutted by the end surface 21 of the connecting member 19 when the quick coupling 11 is connected to the grinding machine 1. The connecting member 19 further includes a projection directed toward the valve member 17 for actuating the valve member 17 against the force of a returning element 22, preferably in the form of a spring which is seated within the valve body and adapted to move the valve member 17 immediately into engagement with its seat 16, i.e. to close the valve device 12, as soon as the quick coupling 11 is disconnected from the grinding tool 1.

For the purpose of providing a quick and reliable connection of the quick coupling 11 to the grinder 1, the latter comprises a laterally projecting sock 23 hving a circular interior functional surface 24 and at least one guide pin 25 projecting inwardly from this surface. For cooperation with this socket 23, the quick coupling 11 comprises an end postion 26 having a circular exterior functional surface 27. This end portion 26 has a guiding groove 28 for cooperation with the guide pin 25 and extending from the end surface of the end portion 26 with an axially extending leg 29 merging into a substantially peripherally extending and slightly pitched leg 30.

For connecting together the quick coupling 11 and the grinder 1, these components are pushed together by a relative axial displacement, with the guide pin 25 engaging the leg 29 of the guiding groove 28. Such axial displacement is allowed until the guide pin occupies an "inner" position in the leg 29 of the guiding groove, in which position the connecting element 19 will have been brought into sealing engagement with the sealing ring 20. The valve device 12 is opened by the action of turning the quick coupling device 11 relative to the socket 23, whereby the guide pin 25 will engage the pitched leg 30 of the guiding groove 28, thereby enforcing the quick coupling 11 simultaneously with the angular movement to be displaced further in the axial direction, in which axial displacement, however, the connecting member 19 cannot partake since it engages the grinding machine 1 through the intermediary of the sealing ring 20. In the other hand, the part comprising the valve seat 16 partakes in the last mentioned movement, and the valve will be opened and/or the through flow area will be regulated by the fact that the connecting member 19 prevents the movable valve member 17 from being displaced together with the valve seat 16.

As an alternative to the above-mentioned quick coupling and valve operating function, the valve opening action may occur already in the last phase of the exclusively axial coupling movement between the quick coupling 11 and the grinder 1, while the flow of pressurized air through the valve device 12 is regulated by turning the quick coupling 1 relative to the socket 23.

The inventive arrangement further comprises at least one catch 31 which is so arranged and designed that when connecting the quick coupling 11 to the grinding machine 1 or disconnecting the connector from the same, a resistance is exerted which has to be overcome to carry out the connecting operation, but allowing a positional change of the quick coupling device 11 relative to the grinding machine 1 without any opposition to this positional change. The catch 31 suitably comprises a catch member 33, for instance in the form of a wire of a resilient material, which is anchored in a socket 32 formed in the quick coupling device 11 and which extends along the branch 30 of the guiding groove or slot 28 and has a bent or chamfered outer end.

To facilitate handling of the grinding machine 1 while machining a working object, the quick coupling device 11 has an external portion 34 forming a handle or a handle portion of the grinding machine 1.

Tthe arrangement exemplified hereinbefore is intended to be illustrative of the invention in a non-limiting sense. The essential thing is that, owing to the inventive arrangement, it will be possible to make use of a suction assembly comprising a quick coupling device 11 with a valve 12 for pressurized air, whereby various kinds of pneumatic machine tools without any valves for pressurized air can be used. The details of an inventive arrangement may be varied within the scope of this principle.

I claim:

1. A normally hand-held pneumatic machine tool and connecting conduit arrangement, including:

a pneumatic machine tool including a housing, said housing containing: a pneumatic motor connectable with a tool for operating the same; socket means; a dust particle suction duct arranged to suck off particles formed while said tool is engaged with a work piece, one end of said suction duct opening into said socket means; and an air supply duct connected at one end thereof with said pneumatic motor, the other end of said air supply duct opening into said socket means, said air supply duct leading directly to said pneumatic motor from said socket means and being unobstructed therebetween;

a quick coupling device arranged to be connectable with and disconnectable from said socket means;

a suction conduit connected with said quick coupling device, and arranged to be connectable thereby to said suction duct within said socket means;

an air supply conduit connected with said quick coupling device; and a valve device carried by said quick coupling device and connected with said air supply conduit, said valve device being operable for controlling the flow of air from said air supply conduit;

said valve device being arranged to be connectable with said other end of said air supply duct within said socket means when said quick coupling device is inserted into said socket means, and controlling the supply of air thereto from said air supply conduit.

2. A normally hand-held pneumatic machine tool and connecting conduit arrangement as recited in claim 1, wherein said valve device includes operating means arranged to be operated by the act of coupling said quick coupling device with said socket means whereby to open said valve device, and to be operated by the act of disconnecting said quick coupling device from said socket means to close said valve device.

3. A normally hand-held pneumatic machine tool and connecting conduit arrangement as recited in claim 1, wherein said quick coupling device is arranged to be axially insertable into said socket means, and to thereafter be turnable relative to said socket means for effecting opening and closing of said valve device.

4. A normally hand-held pneumatic machine tool and connecting conduit arrangement, including:

a pneumatic machine tool including a housing, said housing containing: a pneumatic motor connectable with a tool for operating the same; socket means; a dust particle suction duct arranged to suck off particles formed while said tool is engaged with a work piece, one end of said suction duct opening into said socket means; and an air supply duct connected at one end thereof with said pneumatic motor, the other end of said air supply duct opening into said socket means, said air supply duct leading directly to said pneumatic motor from said socket means and being unobstructed therebetween;

a quick coupling device arranged to be axially insertable into said socket means and to be connectable with and disconnectable from said socket means by turning it in a first, coupling direction, and in the opposite, uncoupling direction, respectively, relative thereto;

a suction conduit connected with said quick coupling device, and arranged to be connectable thereby to said suction duct within said socket means;

an air supply conduit connected with said quick coupling device; and a valve device carried by said quick coupling device and connected with said air supply conduit, said valve device being operable for controlling the flow of air from said air supply conduit, and said other end of said air supply duct including an axially directed end piece arranged to face said socket means, said valve device including:

a valve seat;

a valve element resiliently urged to engage said valve seat; and a connecting element slidably carried by said quick coupling device, and engageable with said valve element;

the outer end of said connecting element being engageable with said end piece of said air supply duct during insertion of said quick coupling device axially into said socket means, and said connecting element being effective during subsequent turning of said quick coupling device in said first, coupling direction relative to said socket means to disengage said valve element from said valve seat to open said valve device, said valve element returning to its seated position to close said valve device when said quick coupling device is turned in the opposite, uncoupling direction.

5. A normally hand-held pneumatic machine tool and connecting conduit arrangement as recited in claim 4, further including:

catch means between said socket means and said quick coupling device, arranged to exert an initial resistance to connecting said quick coupling device with said socket means, but which allows turning of said quick coupling device relative to said socket means after initial connection thereof without resistance, to effect opening and closing of said valve device.

6. A normally hand-held pneumatic machine tool and connecting conduit arrangement as recited in claim 4, wherein said socket means is contained within a projecting portion of said housing arranged to form a handle for holding said machine tool, and wherein said quick coupling device includes a generally cylindrical body arranged to project from said housing when connected with said socket means.

* * * * *